United States Patent [19]

Cole et al.

[11] Patent Number: 4,520,837

[45] Date of Patent: Jun. 4, 1985

[54] COVER RETAINER

[75] Inventors: Clinton W. Cole; Verlin R. Beach, both of Duncan, Okla.

[73] Assignee: Halliburton Company, Duncan, Okla.

[21] Appl. No.: 575,634

[22] Filed: Jan. 31, 1984

[51] Int. Cl.[3] ..... F16K 13/04; F04B 39/12

[52] U.S. Cl. ..... 137/68 R; 417/568; 417/53

[58] Field of Search ..... 137/68 R; 417/568, 53; 29/156.4 R

[56] References Cited

U.S. PATENT DOCUMENTS

| | | | |
|---|---|---|---|
| 1,765,883 | 6/1930 | Ruschke | 137/68 R |
| 1,959,822 | 5/1934 | Greve | 137/68 R |
| 2,580,426 | 1/1952 | Heigis | 137/68 R |
| 3,158,165 | 11/1964 | Benson et al. | 137/68 R |
| 4,426,109 | 1/1984 | Fike, Jr. | 137/68 R |

FOREIGN PATENT DOCUMENTS

| | | | |
|---|---|---|---|
| 651017 | 3/1951 | United Kingdom | 137/68 R |

*Primary Examiner*—William L. Freeh

*Attorney, Agent, or Firm*—Joseph A. Walkowski; Thomas R. Weaver

[57] ABSTRACT

The cover retainer of the present invention is secured to the fluid end of a plunger-type high pressure pump behind a substantially circular protective cover including a shear disc surrounded by an annular outer portion, which cover is held in place by the retainer. When subjected to a compressive load by the plunger in excess of a predetermined limit, the shear disc shears from the outer portion along an arcuate boundary of reduced wall thickness between the center and outer portions and the sheared center portion is propelled by the pressure into the retainer, the interior of which is of substantially frustoconical configuration, with the base of the cone oriented substantially coaxially with respect to the shear disc. As the shear disc enters the interior of the retainer, its energy is substantially dissipated through contact between the periphery of the disc and the retainer inner wall without harm to the retainer.

17 Claims, 3 Drawing Figures

COVER RETAINER

BACKGROUND OF THE INVENTION

It is common practice in the petroleum industry to employ high-pressure plunger-type pumps in a variety of field operations relating to oil and gas wells, such as cementing, acidizing, fracturing, and others. An example of such a high pressure pump is the Halliburton Services HT-400 horizontal triplex pump, manufactured by Halliburton Services of Duncan, Okla. Such pumps commonly generate pressures in excess of ten thousand psi, and are on occasion subject to overpressuring for a variety of reasons. Several common causes of overpressure are blockage of a pump discharge line, the erroneous closure of a valve on the discharge side of the pump, or the phenomenon of "sandout."

Sandout may occur during a fracturing job, wherein the producing formation of the well is subjected to high pressures to crack or "fracture" the producing strata. It is common in such fracturing operations to include a proppant, such as glass or ceramic beads, walnut shells, glass microspheres, sintered bauxite, or sand (hereinafter collectively and individually referred to as "sand") in the carrier fluid, so as to provide a means of maintaining the cracks in the fractured producing formation open after the fracturing pressure is released. Present day fracturing operations often employ a foamed carrier fluid using nitrogen or carbon dioxide as the gaseous phase of the foam, in order to lower the volume and cost of the chemicals required and in many cases to avoid a large hydrostatic force on a weak formation, such as is often encountered in gas wells. There has also recently been a marked tendency to load up the carrier liquid with as much sand as possible prior to foaming, in order to further lower fluid volume requirements and hence job costs to the customer. Such concentrations may reach and exceed sixteen pounds of sand per gallon of carrier fluid. These high sand concentrations impose severe performance demands on the blender, manifold and pump systems due to the erosive effect of the sand and the tendency of slugs of sand to collect in valves, elbows, and in the fluid ends of the high pressure pumps. The collection of sand in these areas is dependent upon a number of parameters, including gravity, fluid flow rate, rheological properties of the carrier fluid, physical properties of the sand and the geometry of the system as a whole.

However, regardless of causation, the concentration of sand associated with a sandout in the fluid end of a high pressure pump can result in sudden overpressuring of the fluid end with resulting damage to one or more of the plunger, connecting rod, crankshaft, or other parts of the pump drivetrain. The overpressuring due to sandout is particularly destructive as the resulting force may be eccentrically applied to the plunger and fluid end, as a slug of sand often collects at the bottom of the plunger, as has been observed.

It has been known in the art to attempt to alleviate this sandout problem with ball type valves in the pumps. However, such valves are susceptible to clogging due to the sand content of the carrier liquid, and may also fail to reclose after the problem is corrected due to the presence of sand in the valve, or the erosive effect of the sand-laden carrier fluid.

Another solution to the overpressuring problem is disclosed in co-pending U.S. application Ser. Nos. 575,635 and 575,633, filed on even date herewith and assigned to the assignee of the present invention. The inventions of the aforesaid co-pending application Ser. No. 575,635 comprises a protective cover including a substantially circular cover having a shear disc surrounded by an annular outer portion, mounted in a cylinder in the fluid end of a plunger-type high pressure pump. An arcuate boundary of reduced wall thickness lies between the shear disc and the outer portion of the cover. The cover is held in place by a retainer assembly of co-pending application Ser. No. 575,633 which is secured to the fluid end, which assembly includes a plug backed by an impact disc at the outer end of the retainer. When a predetermined force is generated by the plunger in the cylinder, the shear disc of the cover shears and is propelled outwardly against the plug, which in turn forces the impact disc against the edge of a circular recess in the outer end of the retainer, the recess lug of lesser diameter than the impact disc. The impact disc, in shearing against the recess edge, safely dissipates the kinetic energy of the shear disc, while the pressure in the cylinder vents to the atmosphere, avoiding damage to the fluid end of the pump, the plunger, connecting rod, crankshaft, etc. However, the retainer employed with the protective cover is expensive to construct, and in order to refurbish a sheared cover and retainer assembly, a new impact disc as well as a new cover must be available. Moreover, the use of a destructible impact disc to absorb energy adds to the operating costs of the pump in which they are employed over a period of time.

SUMMARY OF THE INVENTION

In contrast to the prior art, the present invention comprises a one-piece retainer inserted behind each protective cover inserted in a cylinder of a fluid end of a pump and maintained therein by said retainer, which is secured to the fluid end. The protective cover of copending application Ser. No. 575,635 is substantially circular in configuration, and includes a shear disc surrounded by an annular outer portion, with an arcuate boundary of substantially reduced wall thickness therebetween. When subjected to a load in excess of the shear strength of the arcuate boundary, the cover shears at the boundary and the shear disc is propelled outwardly by the pressure in the fluid end into the retainer of the present invention, the interior of which is of substantially frustoconical configuration, with the base of the cone oriented substantially coaxially with respect to the shear disc. The kinetic energy of the shear disc is substantially dissipated by the contact of the periphery of the disc with the ever-decreasing diameter inner wall of the retainer, which plastically deforms the shear disc. The fluid end of the pump, the plunger, connecting rod, crankshaft, etc. are saved from harm by the venting of the overpressure when the disc shears. After the retainer with trapped shear disc and the sheared cover outer portion are removed from the fluid end, the sand is cleared from the fluid end (if sandout is the cause of the overpressure), a new protective cover may be installed, the retainer of the present invention resecured to the fluid end, the pump restarted and the fracturing operation recommenced.

Thus it is apparent that an effective and substantially fail-safe apparatus for eliminating pump damage from sandout or other cause of overpressuring has been invented. The apparatus of the present invention is relatively simple and inexpensive to manufacture, and is readily refurbished for re-use with a minimum of replacement parts.

BRIEF DESCRIPTION OF THE DRAWINGS

The apparatus of the present invention will be more fully understood by one of ordinary skill in the art through a reading of the following detailed description of a preferred embodiment thereof, taken in conjunction with the accompanying drawings, wherein.

DETAILED DESCRIPTION AND OPERATION OF A PREFERRED EMBODIMENT

Figure 1:
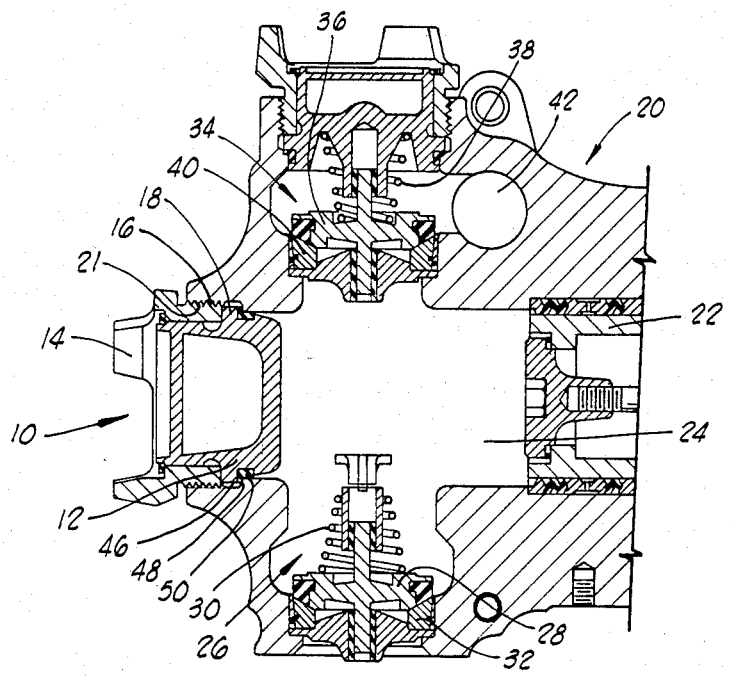
FIG. 1 PRIOR ART
FIG. 1 is a horizontal sectional elevation of a portion of the fluid end of a plunger-type pump employing a cylinder cover of the prior art type.
Figure 2:
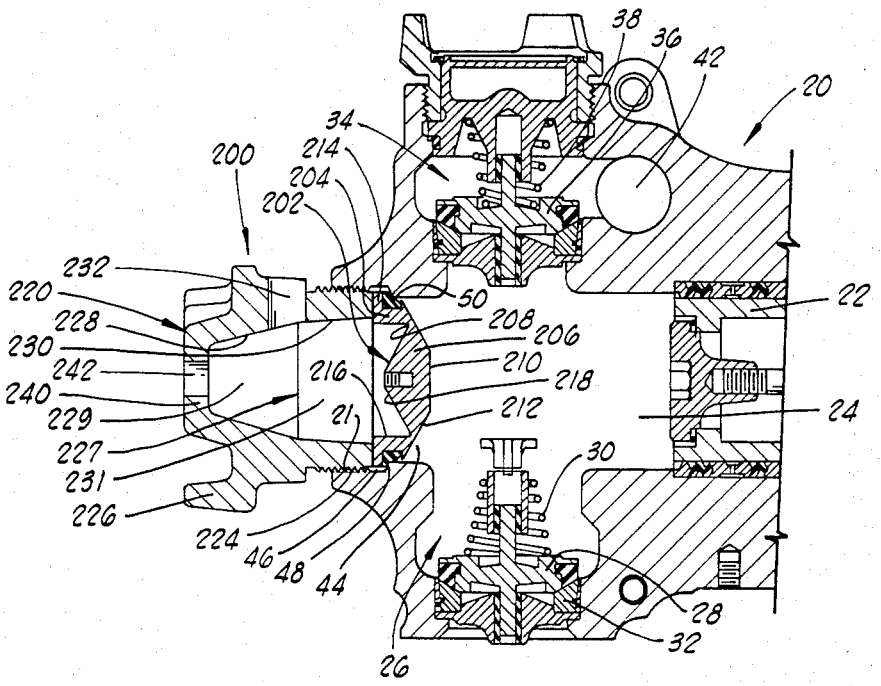
FIG. 2 is a view similar to FIG. 1, but with the cover retainer of the present invention employed.

FIGS. 1 and 2 will be referred to in the following detailed description of the cover retainer of the present invention.

The prior art type of fluid end cover 10 is illustrated in FIG. 1, denoted "Prior Art." Fluid end cover 10 includes a cylindrical plug 12 secured in fluid end 20 by retainer 14 which is secured by threads 16 to threads 21 of fluid end 20. Annular shoulder 18 on cover 12 is clamped between fluid end 20 and retainer 14, shoulder 18 actually abutting wear ring 48, which is inserted in fluid end recess 46 prior to the insertion of plug 12. Elastomeric seal 50, carried on plug 12, provides a fluid-tight seal between plug 12 and the periphery of fluid end recess 46. As can readily be seen, plug 12 is substantially coaxial with pump plunger 22 in cylinder 24. There is, of course, one such plug 12 at the end of each cylinder 24 of fluid end 20. At the bottom of FIG. 1 is suction valve assembly 26, including inlet valve 28 which is biased by spring 30 against valve seat 32. At the top of FIG. 1 is outlet valve assembly 34 including outlet valve 36 which is biased by spring 38 against valve seat 40. In normal pump operation, fluid enters cylinder 24 through suction valve assembly 26 by the withdrawal of plunger 22 from cylinder 24, after which the fluid in cylinder 24 is raised in pressure by the advance of plunger 22 toward plug 12 in cylinder 24, the fluid then exiting from cylinder 24 into outlet passage 42 through outlet valve assembly 34. As this type of plunger pump and its operation are well known in the art, no further explanation will be given thereof, nor of the drive means for plunger 22, such drive means being also well known in the art.

It should be noted that, in the event of an overpressure in cylinder 24 due to one of the aforementioned causes, the prior art plug 12 and retainer 14 offer no means of venting the overpressure, resulting in possible damage to fluid end 20, plunger 22, or parts of the drive train to plunger 22, such as a connecting rod or the pump crankshaft (not shown).

The preferred embodiment of the present invention is illustrated in FIG. 2, inserted in the end of cylinder 24 of fluid end 20 in lieu of cover 10 of the prior art. Protective cover and retainer assembly 200 includes a shallow cup-shaped cover 202 having a cylindrical outer portion 204 and a circular inner shear disc 206 with arcuate boundary 208 of reduced wall thickness therebetween. The inner end of cover 202 has a flat circular end face 210 surrounded by an oblique annular face 212. The exterior of outer portion 204 includes annular flange 214, which is of greater diameter than that of outer end 44 of cylinder 24, but less than that of fluid end recess 46 which communicates with cylinder 24. The outer end of fluid end recess 46 is threaded at 21, as previously noted. The inner wall 216 of outer portion 204 is of substantially constant diameter, terminating at arcuate boundary 208, within which shallow cone 218 of shear disc extends outwardly.

Cover 202 is maintained in fluid end 20 by the insertion of cup-shaped one-piece cover retainer 220 of the present invention into fluid end 20 and the making up of threads 224 on cover retainer 220 to threads 21. Flange 214 is clamped between retainer 220 and fluid end 20, with wear ring 48 being disposed between flange 214 and fluid end 20, seal 50 being carried on cover 202 to provide a fluid-tight seal with fluid end 20. Cover retainer 220 further includes hammer lugs 226 on its exterior, by which cover retainer 220 may be tightly threaded to fluid end 20 by a sledge hammer, as is commonly used in petroleum industry field operations. The interior of cover retainer 220 is of substantially frustoconical configuration, being defined by two contiguous frustoconical inner walls 228 and 230, wall 228 being of greater angular taper than wall 230. At least one aperture 232 extends from the exterior of cover retainer 220 to the interior thereof. The "bottom" 240 of the cup of cover retainer 220 is pierced by axially disposed aperture 242.

It should be understood that the cover retainer 220 of the present invention may be employed with a protective cover 202 at the end of each cylinder 24 in a multicylinder pump, such as the HT-400 horizontal triplex pump employed by Halliburton Services of Duncan, Oklahoma, in well servicing operations, in lieu of the prior art type covers. The positioning of all the elements of protective cover and retainer 200, when installed in a fluid end 20, are as depicted in FIG. 2.

Figure 3:
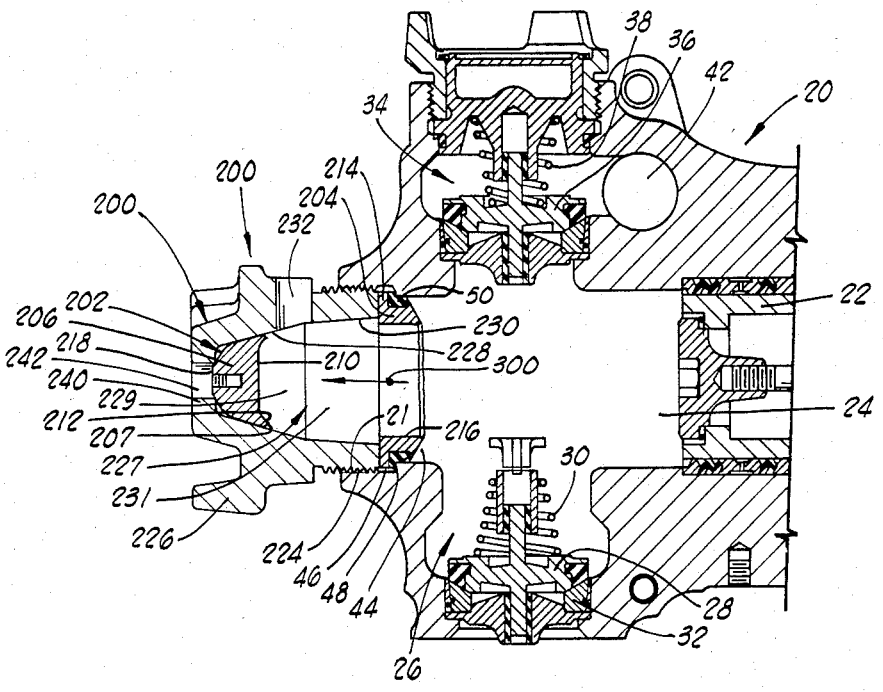
FIG. 3 is a view similar to FIG. 2, but showing the results of overpressuring of a cylinder in the fluid end when the present invention is employed.

When a fluid end 20 equipped with one or more protective covers 202 and retainers 220 of the present invention is subjected to overpressure, the pressure is vented from the overpressured cylinder or cylinders 24 as shown in FIG. 3.

When the pressure in cylinder 24 exceeds the design shear load of arcuate boundary 208, shear disc 206 of protective cover 202 is sheared from outer portion 204 and is propelled outwardly as shown by arrow 300 in FIG. 3.

Tapered bore 231 defined by inner wall 230 is of greater inner diameter throughout its length than the diameter of shear disc 206 (as defined by the diameter of arcuate boundary 208) and therefore will not substantially interfere with the movement of shear disc 206, even if the shearing along boundary 208 is eccentric and movement of shear disc 206 is not entirely coaxial. However, at the line 227 where tapered bore 229 (defined by tapered wall 228) begins, the diameters of bore 229 and shear disc 206 are substantially the same. Thereafter, bore 229 rapidly narrows so that the periphery 207 of sheared shear disc 206 will contact inner wall 228 and will deform as its progresses to the end of bore 229 at the bottom 240 of retainer 220 (FIG. 3) whereby the kinetic energy of shear disc 206 is safely dissipated. Aperture 242 in retainer 220 permits safe venting of the pump pressure to the atmosphere by redirecting the pressurized fluid upward, while aperture 242 prevents compression of air in the bottom of retainer 220, and permits easy removal of shear disc 206 from retainer 220 by insertion of an appropriate instrument through aperture 242 and striking with a hammer.

In order to prepare the fluid end 20 of the pump for service after an overpressure, each retainer 220 which has vented is backed off from fluid end 20, and both shear disc 206 and outer portion 204 of protective cover 202 are discarded. A new (unsheared) cover 202 is provided, and inserted with a wear ring 48 and seal 50 into each cylinder 24 of fluid end 20 which was previously vented, after which retainer 220 is threaded into fluid end 20 behind cover 202.

If the overpressure in cylinder 24 is caused by sand-out, the shearing of shear disc 206 may be eccentric, and shear disc 206 may not strike bore 229 of retainer 220 squarely. However, the force will still be transmitted to inner wall 228, and may in fact be less than in an instance of uniform shear, as part of the pressure may be vented to the atmosphere as shear disc 206 shears rather than acting to propel shear disc 206 outward.

It will be understood by one of ordinary skill in the art that all of the protective cover and retainer assembly 200 may preferably be fabricated from a suitable steel such as AISI 4140. It will also be understood that the protective cover 202 should be designed to fail (shear disc 206 shear) at or less than the design plunger load, in order to prevent damage to the plunger 22 and the pump drivetrain.

In addition to design for failure at a certain predetermined load, the protective cover employed in the present invention must possess an adequate fatigue life at the rated pressure of the pump in which it is employed, in order to avoid frequent replacement of the cover and/or unexpected failures due to fatigue. Ideally, the maximum plunger force effecting cover failure (shear) would be only slightly higher than the maximum force generated during normal pump operations. However, such an approach would result in an unacceptably short fatigue life. In order to obtain an acceptable fatigue life of 300,000 plunger cycles, the maximum plunger force for cover failure is much higher. For example, in a pump employing a $4\frac{1}{2}''$ plunger and a normal maximum operating pressure of approximately 11,000 psi, the plunger pressure required for failure of a cover having a 300,000 cycle fatigue life is about 18,000 psi. Accordingly, taking into account the geometry of the protective cover 202, including the diameter of shear disc 206, and circumferential length of arcuate boundary 208, as well as the hardness of the cover material employed, an appropriate wall thickness for arcuate boundary 208 may readily be selected by one of ordinary skill in the art.

Thus, it is apparent that a novel and unobvious protective cover and retainer has been invented, the present invention being simple and inexpensive to manufacture and to refit for multiple uses with a minimum of replacement parts. While the invention has been disclosed in terms of a preferred embodiment, the spirit and scope of the invention is not so limited. For example, the present invention need not be employed in coaxial relationship to a pump plunger, and the interior of retainer 220 might be of other than circular configuration, or the outer end of the shear disc might be elongated, and the retainer have a solid bottom, the elongated end of the shear disc deforming to dissipate the kinetic energy of the sheared disc. These and other additions, deletions and modifications will be evident to one of ordinary skill in the art.

Furthermore, while the cover retainer of the present invention has been shown to have utility in well fracturing operations, it should be understood that its utility is not so limited. The present invention may be employed in high pressure plunger-type pumps of every nature, whatsoever their use may be, in order to prevent damage to the pump and components thereof and injury to personnel from overpressures relieved by a protective cover.

We claim:

1. A cover retainer for a fluid end of a plunger-type pump adapted to retain a portion of a protective cover including first and second disc-shaped portions adapted to separate along a boundary therebetween when subjected to cylinder pressure above a predetermined limit, said cover being provided to relieve pressure in a cylinder of said pump when said pressure exceeds said predetermined limit, comprising:

a receptacle including means on the exterior thereof for securing said receptacle to said fluid end, said receptacle including a cup-shaped cavity of generally frusto-conical configuration therein, the mouth of said cavity being disposed adjacent said cover, and the cross-sectional area of said cavity decreasing from the mouth of said cavity to the bottom of said cavity.

2. The article of claim 1, wherein the mouth of said cavity is of only slightly greater diameter than said disc, and the bottom of said cavity is of lesser diameter than said disc.

3. The article of claim 2, including at least one aperture therein extending through the inside wall of said cavity to the exterior of said receptacle.

4. The article of claim 1 wherein said frustoconical cavity comprises a first section adjacent the mouth thereof and having a first, lesser wall angle of inclination to the axis of said cavity, and a second section adjacent to and coaxial with said first section and having a second, greater wall angle of inclination to said axis.

5. The article of claim 4, wherein the mouth of said cavity is of only slightly greater diameter than said disc, and the bottom of said cavity is of lesser diameter than said disc.

6. The article of claim 5, wherein said retainer includes at least one aperture therein extending from the side of said cavity to the exterior of said receptacle.

7. The article of claim 6, wherein said securing means includes exterior threads on said receptacle.

8. A cover retainer adapted to be disposed in the end of a cylinder of a fluid end of a plunger-type pump behind a protective cover including an outer portion including a disc-shaped inner portion circumferentially surrounded by said outer portion; and a boundary comprising an area of reduced wall thickness between said inner and outer portions and adapted to fail above a predetermined pressure in said cylinder; said cover retainer comprising:

means for catching said inner portion after said boundary has failed, said means for catching including a cup-shaped cavity of generally frusto-conical configuration having a cross-sectional area at the bottom thereof less than the cross-sectional area of said inner portion.

9. The article of claim 8, wherein at least one aperture extends from the interior of said receptacle to the exterior thereof.

10. The article of claim 8, wherein the mouth of said cavity is of only slightly greater diameter than said disc, and the bottom of said cavity is of lesser diameter than said disc.

11. The article of claim 10, wherein said frusto-conically configured cavity includes a first section adjacent the mouth thereof and having a first, lesser wall angle of inclination to the axis of said receptacle and a second section adjacent to and coaxial with said first section and having a second, greater wall angle of inclination to said axis.

12. The article of claim 8, further including means for securing said catching means to said fluid end.

13. The article of claim 12, wherein said securing means comprises mating threads on said catching means and said fluid end.

14. In a method of preventing overpressure in a fluid end of a plunger-type pump, comprising providing an aperture in said fluid end in communication with at least one cylinder in said fluid end and the exterior of said pump; sealingly blocking said aperture with a protective cover including first outer and second inner portions adapted to separate along a predetermined boundary above a predetermined pressure limit; securing said cover in said aperture; and operating said pump whereby pressure in said at least one cylinder exceeds said predetermined pressure limit, whereby said second portion separates from said first portion and is propelled outwardly from said cylinder, said pressure being vented to the exterior of the pump, the improvement comprising:

catching said second portion of said cover proximate said fluid end; and dissipating the kinetic energy of said second portion of said cover thereby deforming said second portion.

15. The method of claim 14, wherein said deforming said second portion comprises deforming the periphery of said second portion.

16. The method of claim 14, including providing an aperture in each cylinder of said fluid end, sealingly blocking each aperture with a protective cover, catching each of said second portions propelled outwardly and dissipating said kinetic energy thereby deforming each of said second portions.

17. The method of claim 14, further comprising substantially coaxially aligning said cylinder, said cover, and said aperture.

* * * * *